US008770154B2

(12) United States Patent
Vroom

(10) Patent No.: US 8,770,154 B2
(45) Date of Patent: Jul. 8, 2014

(54) HEAT EXCHANGER WATER HEATING SYSTEM FOR COMMERCIAL DISHWASHER

(75) Inventor: Robert C. Vroom, Kernersville, NC (US)

(73) Assignee: Champion Industries, Inc., Winston-Salem, NC (US)

( * ) Notice: Subject to any disclaimer, the term of this patent is extended or adjusted under 35 U.S.C. 154(b) by 1336 days.

(21) Appl. No.: 12/553,341

(22) Filed: Sep. 3, 2009

(65) Prior Publication Data

US 2011/0048342 A1 Mar. 3, 2011

(51) Int. Cl.
*F22B 31/00* (2006.01)

(52) U.S. Cl.
USPC ..... 122/367.1; 134/56 D; 134/57 D; 134/58 D; 134/10

(58) Field of Classification Search
USPC ..... 122/367.1, 33; 134/56 D, 57 D, 58 D; 411/531; 510/220; 312/228, 229; 4/625; 60/641.3, 39.12; 165/111; 126/362.1; 237/19, 8 R
See application file for complete search history.

(56) References Cited

U.S. PATENT DOCUMENTS 2,564,798 A * 8/1951 Allensworth ..... 134/60
3,520,726 A * 7/1970 Gay ..... 134/63
3,598,131 A * 8/1971 Weihe, Jr. ..... 134/107
3,965,494 A * 6/1976 Baker ..... 4/615
4,083,398 A * 4/1978 Fallon et al. ..... 165/66
4,125,148 A * 11/1978 Molitor ..... 165/60
4,129,179 A * 12/1978 Molitor ..... 165/101
4,254,788 A * 3/1981 Helwig, Jr. ..... 134/57 D
4,315,140 A * 2/1982 Helwig, Jr. ..... 219/486
4,331,484 A * 5/1982 Helwig, Jr. ..... 134/18
4,519,440 A * 5/1985 Weitman ..... 165/104.11
4,529,032 A * 7/1985 Molitor ..... 165/301
4,531,572 A * 7/1985 Molitor ..... 219/201
4,932,227 A * 6/1990 Hogrefe ..... 68/17 R
5,257,171 A * 10/1993 Hara ..... 700/14
5,331,984 A * 7/1994 Isagawa ..... 134/57 D
5,660,193 A * 8/1997 Archer et al. ..... 134/56 D
5,791,401 A * 8/1998 Nobile ..... 165/47
5,884,694 A * 3/1999 Tanenbaum ..... 165/125
5,934,078 A * 8/1999 Lawton et al. ..... 62/3.1
6,041,613 A * 3/2000 Morse et al. ..... 62/305
6,072,153 A * 6/2000 Aoki et al. ..... 219/202
6,176,305 B1 * 1/2001 Haglid ..... 165/231
6,357,245 B1 * 3/2002 Weng et al. ..... 62/238.6

(Continued)

FOREIGN PATENT DOCUMENTS

DE 102009026876 A1 * 12/2010

*Primary Examiner* — Kang Hu
*Assistant Examiner* — Eric Gorman
(74) *Attorney, Agent, or Firm* — Coats and Bennett, P.L.L.C.

(57) ABSTRACT

A multi-chamber conveyor type dishwasher uses a heat recovery unit (HRU) to heat water for a final rinse chamber during a preheat and/or dishwashing phase. The HRU heats water supplied by a low temperature water source using the dishwasher's hot vapor exhaust. An input supply of water for a downstream booster heater is varied based on a sensed temperature of the HRU's output water. If the temperature is acceptable, the HRU supplies input water to the booster heater for the rinse chamber. When the temperature drops below a threshold, the controller temporarily bypasses the HRU and supplies water to the booster heater from a high temperature water source. The HRU may be primed during a preheat phase using water from the high temperature water source. An amount of fan force used to pull the hot exhaust vapors through the HRU may vary based on the status of the dishwasher.

12 Claims, 5 Drawing Sheets

(56) References Cited

U.S. PATENT DOCUMENTS

| | | | | |
|---|---|---|---|---|
| 6,823,878 | B1 * | 11/2004 | Gadini | 134/58 D |
| 6,895,788 | B2 * | 5/2005 | Montgomery | 68/12.02 |
| 7,475,703 | B2 * | 1/2009 | Kempf et al. | 137/377 |
| 8,052,804 | B2 * | 11/2011 | Scheringer et al. | 134/56 D |
| 8,157,924 | B2 * | 4/2012 | Warner et al. | 134/56 D |
| 8,245,948 | B2 * | 8/2012 | Cho et al. | 237/12.1 |
| 8,498,523 | B2 * | 7/2013 | Deivasigamani et al. | 392/308 |
| 2001/0042557 | A1 * | 11/2001 | Moh | 134/10 |
| 2002/0153133 | A1 * | 10/2002 | Haglid | 165/231 |
| 2003/0005731 | A1 * | 1/2003 | Montgomery | 68/107 |
| 2003/0178498 | A1 * | 9/2003 | Saitoh et al. | 237/2 B |
| 2004/0123880 | A1 * | 7/2004 | Chiles et al. | 134/22.18 |
| 2004/0200905 | A1 * | 10/2004 | Saitoh et al. | 237/19 |
| 2004/0227003 | A1 * | 11/2004 | Alvarez et al. | 237/8 R |
| 2004/0261820 | A1 * | 12/2004 | Monsrud et al. | 134/10 |
| 2005/0167516 | A1 * | 8/2005 | Saitoh et al. | 237/2 B |
| 2005/0252027 | A1 * | 11/2005 | Kolari | 34/513 |
| 2006/0073430 | A1 * | 4/2006 | Chiles et al. | 431/3 |
| 2007/0089230 | A1 * | 4/2007 | Hendricks | 4/596 |
| 2007/0170270 | A1 * | 7/2007 | Jelinek et al. | 236/12.11 |
| 2007/0210118 | A1 * | 9/2007 | Gadini | 222/361 |
| 2007/0227560 | A1 * | 10/2007 | Doherty et al. | 134/25.2 |
| 2008/0000616 | A1 * | 1/2008 | Nobile | 165/47 |
| 2008/0077281 | A1 * | 3/2008 | Gaus | 700/299 |
| 2008/0115807 | A1 * | 5/2008 | Gaus | 134/18 |
| 2008/0245394 | A1 * | 10/2008 | Doherty et al. | 134/21 |
| 2009/0120465 | A1 * | 5/2009 | Peukert et al. | 134/30 |
| 2009/0151750 | A1 * | 6/2009 | Ecker et al. | 134/18 |
| 2009/0178662 | A1 * | 7/2009 | Deng | 126/5 |
| 2009/0250085 | A1 * | 10/2009 | Gaus et al. | 134/56 D |
| 2010/0229804 | A1 * | 9/2010 | Okamoto et al. | 122/18.2 |
| 2010/0243202 | A1 * | 9/2010 | Han et al. | 165/62 |
| 2010/0329650 | A1 * | 12/2010 | Kim et al. | 392/449 |
| 2012/0073608 | A1 * | 3/2012 | Rieger et al. | 134/25.2 |
| 2012/0125373 | A1 * | 5/2012 | Grull et al. | 134/25.2 |

* cited by examiner

HEAT EXCHANGER WATER HEATING SYSTEM FOR COMMERCIAL DISHWASHER

BACKGROUND

Food industry businesses typically use commercial dishwashers to clean the large volume of dirty dishes produced each day. Exemplary commercial dishwashers include batch type dishwashers with a single chamber and conveyor type dishwashers with one or more chambers. Generally, multiple-chamber conveyor dishwashers have one or more wash chambers (e.g., prewash and wash chambers) and one or more rinse chambers (e.g., power rinse and final rinse chambers). To wash the dishes, a conveyor belt carries racks of dishes through each chamber.

To meet health safety standards, e.g., the standards set by NSF International, the final rinse chamber typically sanitizes the dishes using a chemical solution or high temperature water. Dishwashers using a chemical-based final rinse process create chemical waste that may require additional processing to reduce environmental impact. Hot water-based final rinse processes do not create chemical waste, but do require a significant amount of energy to achieve the required relatively high water temperature (e.g., 180° F.). For heating the water sufficiently, the final rinse module in a conventional conveyor type dishwasher may include a so-called booster heater that boosts the temperature of water to the required final temperature. Frequently, the water supplied to the booster heater comes from a high temperature external water source (e.g., the building's hot water heater). However, continuously providing heated water from a high temperature external water source requires significant energy. Commercial dishwasher manufacturers therefore continue to search for environmentally friendly and energy efficient ways to meet the sanitizing requirements of a final rinse stage.

SUMMARY

The present invention provides a multi-chamber conveyor dishwasher that uses a vapor-based heat recovery unit (HRU) to provide an energy efficient and environmentally friendly hot water source for the dishwasher. In one exemplary embodiment, the HRU heats water supplied by a low temperature external water supply using heat recovered from hot vapors exhausted by the dishwasher. For example, the HRU may include a plurality of fans that pull the exhausted hot vapors across a heat exchanger containing the water supplied by the low temperature external water source. In addition, a controller of the present invention selects an input supply of water for the relevant downstream booster heater based on a sensed temperature of the water at the output of the HRU. When the water temperature at the output of the HRU meets or exceeds a threshold, the controller supplies water from the HRU to the booster heater. However, when the water temperature at the output of the HRU drops below the threshold, the controller invokes bypass operations to temporarily bypass the HRU and supply the booster heater with water from a high temperature external water source that meets or exceeds the threshold.

In one embodiment, the controller activates a bypass timer to limit the duration of the temporary bypass operations. Upon expiration of the bypass timer, the controller disconnects the booster heater from the high temperature external water source and reconnects the booster heater to the HRU and low temperature water source. In so doing, the present invention continuously provides hot water at a required final temperature to the dishwasher. Further, by using exhausted hot vapors to heat water from a low temperature external water source, the HRU reduces the amount of energy required to heat water while simultaneously reducing the amount of hot vapors released into the environment.

In another exemplary embodiment, the present invention may additionally or alternatively prime the HRU during a preheat phase using water supplied by a high temperature external water source. For example, during a first portion of the preheat phase, the controller may connect the HRU to the high temperature external water source to route preheated water from the high temperature external water source through the HRU while filling one or more of the chambers in the dishwasher with the preheated water. Priming the HRU with water from the high temperature external water source allows the HRU to be more quickly available for supply to the downstream booster heater.

In another exemplary embodiment, the present invention may additionally or alternatively use a variable number of fans to pull the warm vapors across the heat exchanger. For example, the HRU may have a plurality of fans, and during a second portion of the preheat phase, the controller may activate a subset of the fans to pull hot vapors exhausted by the dishwasher across the heat exchanger to extract heat to maintain or increase the temperature of the water in the HRU. In so doing the present invention primes the HRU to provide water at a temperature greater than or equal to the temperature threshold after the preheat phase. Upon completion of the preheat phase, the controller switches the HRU infeed to the low temperature external water source, and the HRU heats the water flowing through the heat exchanger using exhausted hot vapors as discussed above, but using an larger number of fans.

The various aspects of the invention, such as the HRU "booster heater infeed control" operation, the HRU priming with hot water operation, and limiting the number of fans operating in certain situations, may be used alone or in combination, as is desired. Advantageously, these aspects are present in a given unit, but such is not required for all embodiments.

DETAILED DESCRIPTION

The present invention relates a multi-stage conveyor type dishwasher that includes a vapor-based heat recovery unit (HRU) to provide an energy efficient solution for providing heated water to one or more chambers of the dishwasher, e.g., the final rinse chamber. The following describes the present invention in terms of providing water at a sufficiently high temperature to a final rinse chamber of the dishwasher during a preheat phase and/or final rinse phase. It will be appreciated, however, that the present invention may be used for any dishwasher chamber and any dishwashing phase requiring heated water.

Figure 1:
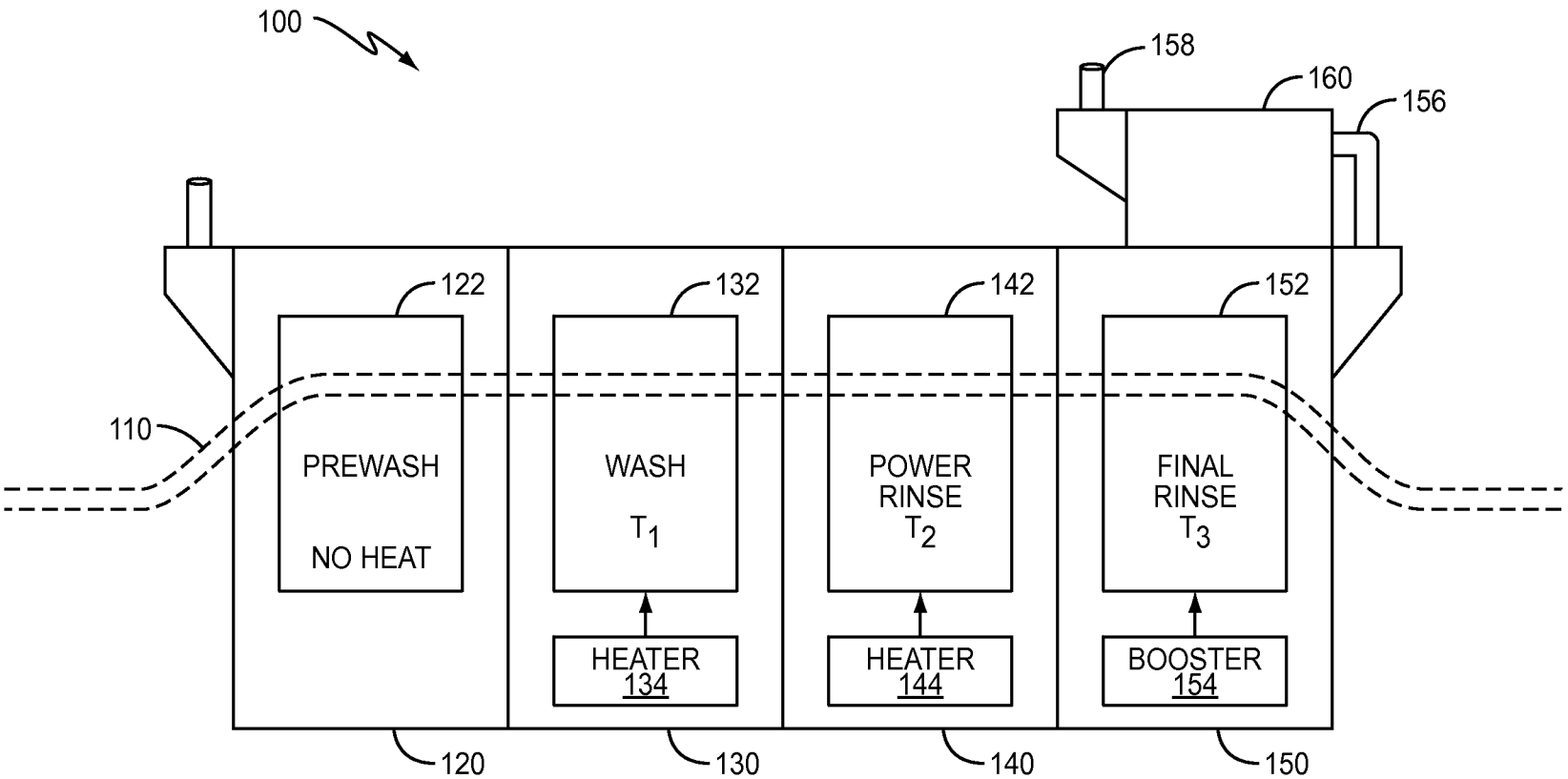
FIG. 1 shows a multi-chamber conveyor dishwasher according to one exemplary embodiment of the present invention.

FIG. 1 shows an exemplary multi-stage conveyor type dishwasher 100 according to one embodiment of the present invention. Dishwasher 100 comprises a conveyor belt 110, prewash module 120, wash module 130, power rinse module 140, final rinse module 150, and HRU 160. It will be appreciated that the present invention is not limited to the specific number or types of modules shown in FIG. 1.

Conveyor belt 110 moves through each module 120-150 to convey racks (or "trays") of dishes through the dishwasher 100. Prewash module 120 comprises a prewash chamber 122 that prewashes dishes using water initially supplied by an external water source to remove large pieces of food. Generally, the prewash chamber 122 uses unheated or minimally heated water. Wash module 130 comprises wash chamber 132 and a heater 134. An external water source initially supplies water to the heater 134. When in use, the heater 134 heats water re-circulated from the wash chamber 132 to a desired temperature $T_1$, e.g., 150° F. The wash chamber 132 washes the dishes exiting the prewash module 120 with detergent mixed with the water output by heater 134 to remove any remaining food from the dishes. Power rinse module 140 comprises a power rinse chamber 142 and a heater 144. An external water source initially supplies water to the heater 144. When in use, the heater 144 heats water re-circulated from the power rinse chamber 142 to a desired temperature $T_2$, e.g., 160° F. The power rinse chamber 142 rinses the soapy water and any remaining food from the dishes exiting the wash module 130 using the water output by heater 144. Final rinse module 150 comprises a final rinse chamber 152 and a booster heater 154. The booster heater 154 boosts the temperature of input water to a desired sanitation temperature $T_3$, e.g., 180° F. The final rinse chamber 152 sanitizes the dishes exiting the power rinse module 140 using the temperature boosted water output by the booster heater 154.

As discussed above, continuously flowing preheated water from a high temperature external water source into a booster heater 154 requires substantial energy. To address this problem, some embodiments of the present invention provide a method and apparatus that continuously supplies the final rinse chamber 152 with water heated to the required final temperature without requiring a continuous supply of high temperature water from a high temperature external water source 20. More particularly, some embodiments of the present invention selectively supply water to the booster heater 154 from either a heat recovery unit (HRU) 160 or the high temperature external water source 20 based on temperature measurements taken during the final rinse phase. When in operation, the HRU 160 heats water supplied by a low temperature external water source 10 using heat recovered from the hot vapors exhausted from the final rinse chamber 152 through exhaust 156. These vapors are a mix of the warm air and moisture (sub-boiling point steam) from within the dishwasher 100, and particularly that from the final rinse chamber 152. An exhaust 158 exhausts any residual hot vapors from the HRU 160. Regardless of its infeed water source, the booster heater 154 boosts the temperature of input water to the required final temperature, and outputs the temperature boosted water to the final rinse chamber 152 during the final rinse phase.

Figure 2:
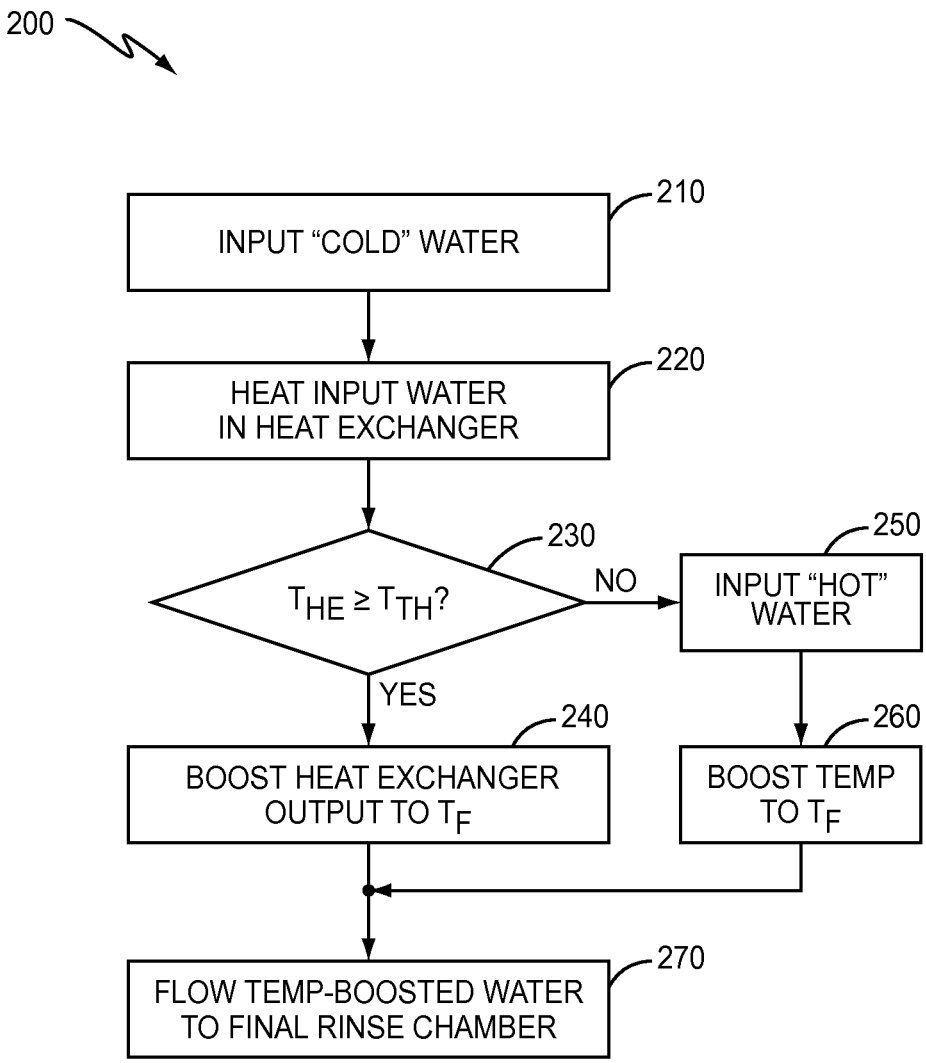
FIG. 2 shows a process for heating water for the dishwasher of FIG. 1 according to one exemplary embodiment of the present invention.

FIG. 2 shows one exemplary process 200 for using the HRU 160 as part of a water heating process for the final rinse chamber 152. A low temperature external water source 10 supplies unheated or minimally heated water (e.g., at 60° F.) to the HRU 160 (block 210). Hot vapors exhausted from the final rinse chamber 152 is captured via exhaust 156 and routed to the HRU 160 where it is utilized by the HRU 160 to heat the low temperature input water (block 220). The booster heater 154 is generally capable of increasing the temperature of input water by a fixed amount, e.g., 60° F. to 70° F. for a given flow rate. To output water at the required final temperature, the temperature of the water input to the booster heater 154 should therefore meet or exceed a temperature threshold, e.g., 110° F. As long as the temperature of the water flowing out of the HRU 160 meets the threshold (block 230), HRU 160 continues to serve as the infeed water source for the booster heater 154, which boosts the temperature of input water to the final temperature (block 240). However, if the temperature of the HRU output water drops below the threshold (block 230), the present invention bypasses the HRU 160 and supplies the booster heater 154 with water that meets or exceeds the temperature threshold from a high temperature external water source 20 (block 250). The booster heater 154 boosts the temperature of the water supplied by the high temperature external water source to the final temperature (block 260). In either case, the booster heater 154 continuously outputs the temperature boosted water to the final rinse chamber 152 during the final rinse phase (block 270).

Figure 3:
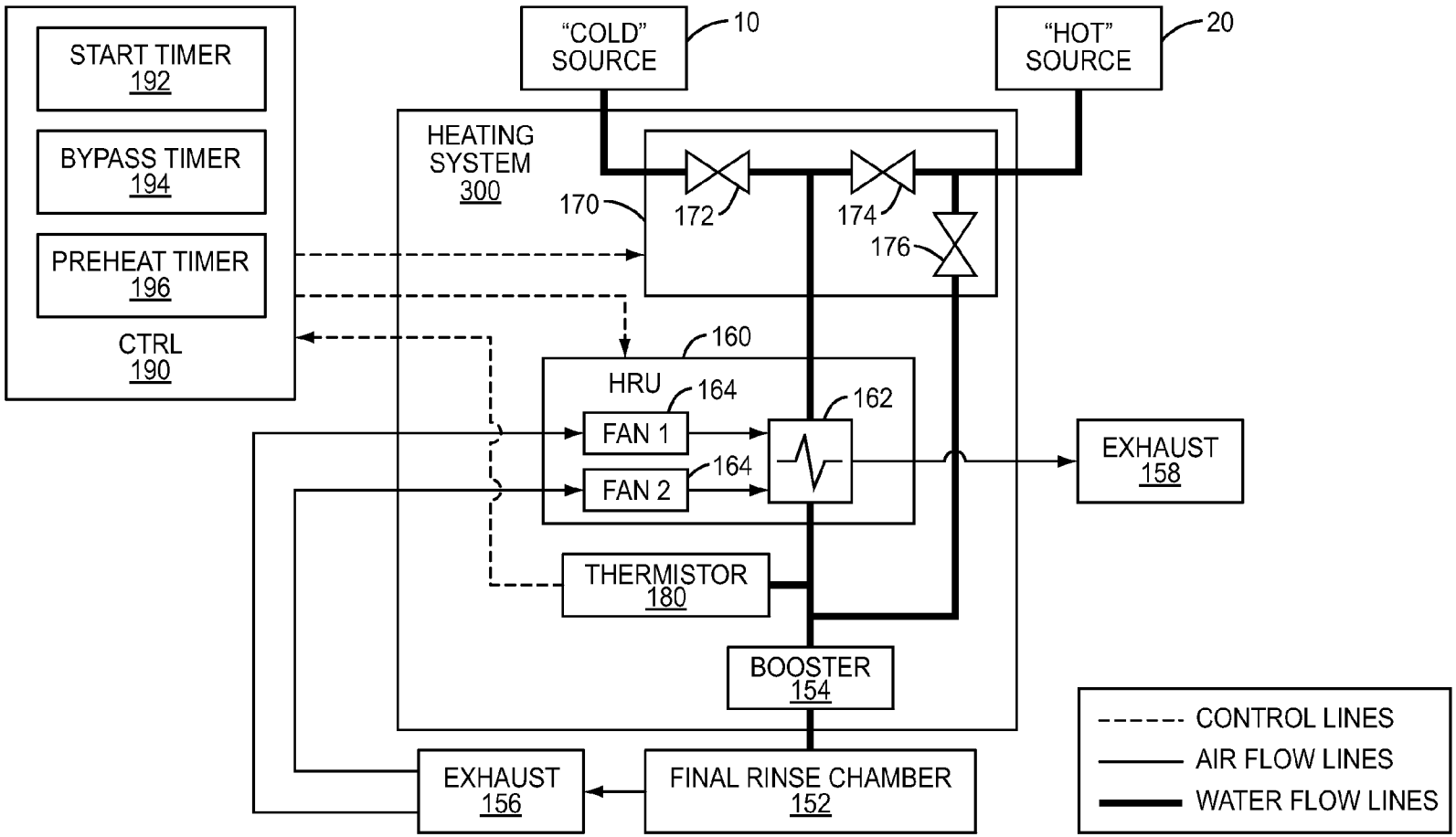
FIG. 3 shows a heat recovery unit for the dishwasher of FIG. 1 according to one exemplary embodiment of the present invention.

FIG. 3 shows an exemplary heating system 300 and controller 190 for executing the exemplary water heating process 200 of FIG. 2. Heating system 300 comprises the booster heater 154, the HRU 160, a valve system 170 connected to both a low temperature external water source 10 and a high temperature external water source 20, and a temperature monitor 180. It will be appreciated that while the low temperature water source 10 generally comprises an unheated water source, the low temperature water source 10 may comprise any water source that supplies water at a lower temperature than the high temperature water source 20 and below the threshold temperature discussed above. Further, while FIG. 3 only shows controller 190 operatively connected to heating system 300, it will be appreciated that the controller 190 may also control other dishwasher operations, e.g., movement of the conveyor belt 110, heating units 134, 144 in other modules 130, 140, etc. Thus, while controller 190 may be implemented as part of the heating system 300, FIG. 3 shows the controller 190 as separate from the heating system 300. Further, as can be appreciated, controller 190 may be embodied in hardware and/or software (including firmware, resident software, microcode, etc.), including an application specific integrated circuit (ASIC).

Valve system 170 comprises multiple valves 172, 174, 176. As described in further detail below, controller 190 opens and closes the valves 172, 174, 176 in valve system 170 to supply water from the desired external water source 10, 20 (which are connected in parallel) to the desired location within the heating system 300. For example, valve 172 comprises a final rinse valve that opens/closes to control water flow from the low temperature external water source 10 to the HRU 160, while valves 174, 176 comprise a preheat valve 174 and bypass valve 176, respectively, that open/close to control water flow from the high temperature external water source 20 to the HRU 160 and booster heater 154, respectively.

HRU 160 advantageously comprises a heat exchanger 162 disposed in a housing with a plurality of fans 164. The HRU 160 heats water in or flowing through the heat exchanger 162 using hot vapors pulled across the heat exchanger 162 by the fans 164. The heat exchanger 162 may comprise any known tubes, coils, plates, etc., that facilitate heat exchange between water and hot vapors. The heat exchanger 162 may be oriented at any angle, but a horizontal orientation with vertical vapor through-flow is believed advantageous.

The heating system 300 implements a final rinse "booster heater infeed control" phase under the control of the controller 190. The final rinse phase, which generally follows a preheat phase as discussed further below, generally comprises a cycle start stage and an equilibrium stage. During the cycle start stage, the controller 190 triggers a cycle start timer 192, opens a final rinse valve 172 in the valve system 170 to flow water from the low temperature external water source 10 into the HRU 160, and closes preheat valve 174 and bypass valve 176. The water supplied by the low temperature external water source 10 flows through the heat exchanger 162 while one or more fans 164 pull hot vapors exhausted by the final rinse chamber 152 across the heat exchanger 162 to heat the low temperature input water.

Upon expiration of cycle start timer 192, temperature monitor 180 measures the temperature of the water output by the HRU 160. Temperature monitor 180 may take the form of any known temperature monitoring unit, e.g., a thermistor, thermocouple, etc., that monitors the temperature of the water at the output of the HRU 160. If the temperature of the HRU output water is less than a predetermined threshold $T_{th}$, controller 190 responds by triggering bypass operations to close the final rinse valve 172 and open the bypass valve 176, while preheat valve 174 remains closed. By opening bypass valve 176 and closing the final rinse valve 172, the controller 190 bypasses the HRU 160 and flows water directly from the high temperature external water source 20 into the booster heater 154. In so doing, the controller 190 ensures that the booster heater 154 receives a continuous supply of heated water at or above the predetermined temperature threshold.

In some embodiments, the bypass operations continue until the temperature of the water at the output of the HRU 160 reaches the threshold temperature. In other embodiments, the bypass operations continue until expiration of a bypass timer 194 triggered at the beginning of the bypass operations. In either case, upon completion of the bypass operations, controller 190 once again triggers the cycle start timer 192 and controls the valve system 170 and HRU 160 to execute the cycle start phase. In particular, the controller 190 controls the valve system 170 to disconnect the external hot water source 20 from the booster heater 154, and to reconnect the booster heater 154 to the HRU 160 and the low temperature external water source 10.

The cycle start stage ends once the temperature of the water at the output of the HRU 160 meets or exceeds the predetermined threshold $T_{th}$ after expiration of the cycle start timer 192. Subsequently, controller 190 turns off all timers, and enters the equilibrium stage. During the equilibrium stage, the temperature monitor 180 continues to monitor the temperature of the water output by the HRU 160. If the temperature of the water output by the HRU 160 drops below the predetermined threshold during the final rinse phase, the controller 190 repeats the temporary bypass operations described above without using the cycle start timer. This process of supplying heated water to the booster heater 154 from the HRU 160 whenever the temperature threshold is satisfied, and from the high temperature external water source 20 otherwise, repeats throughout the final rinse phase. In this manner, the heating system 300 provides the final rinse chamber 152 with a continuous supply of hot water at or above the required final temperature during the final rinse phase without requiring a continuous supply of hot water from the high temperature external water source 20.

The HRU 160 of the present invention may advantageously preheat water during a preheat phase executed before the final rinse phase. The preheat phase for the final rinse chamber 152 may occur anytime before the dish racks on the conveyor belt 110 arrive at the final rinse chamber 152. During a first portion or sub-phase of the preheat phase, controller 190 opens preheat valve 174 to route hot water from the high temperature external water source 20 through the HRU 160 and into one or more of the dishwasher chambers. Once each chamber contains the desired amount of water, the controller 190 closes the preheat valve 174, and places the dishwasher in a standby state, where the water pumps, heaters 134, 144, 154, and fans, are deactivated to conserve energy. This portion of the preheat phase typically occurs infrequently, e.g., once a day, and typically occurs before any dishes are input to the dishwasher 100. During the first portion of the preheat phase and any subsequent standby states, the HRU 160 is heated by conduction.

During a second portion of the preheat phase, the dishwasher 100 further primes the HRU 160. For example, when a dish rack enters the dishwasher 100, the controller 190 may trigger a preheat timer 196 in the controller 190, and activate a subset of the total number of fans, e.g., one of the two fans 164 shown in FIG. 3, in the HRU 160 to draw the hot vapors exhausted by the final rinse chamber 152 across the heat exchanger 162. In so doing, HRU 160 at least maintains the temperature of the preheated heat exchanger 162, and advantageously increases the temperature of the preheated heat exchanger 162. Upon expiration of the preheat timer 196, controller 190 begins the final rinse phase by triggering the cycle start timer 192 and executing the water heating process described above. To handle the larger quantities of hot vapors exhausted during the final rinse phase relative to the preheat phase, and the increased need for heat extraction, the controller 190 may also activate the remaining fans 164.

Figure 4:
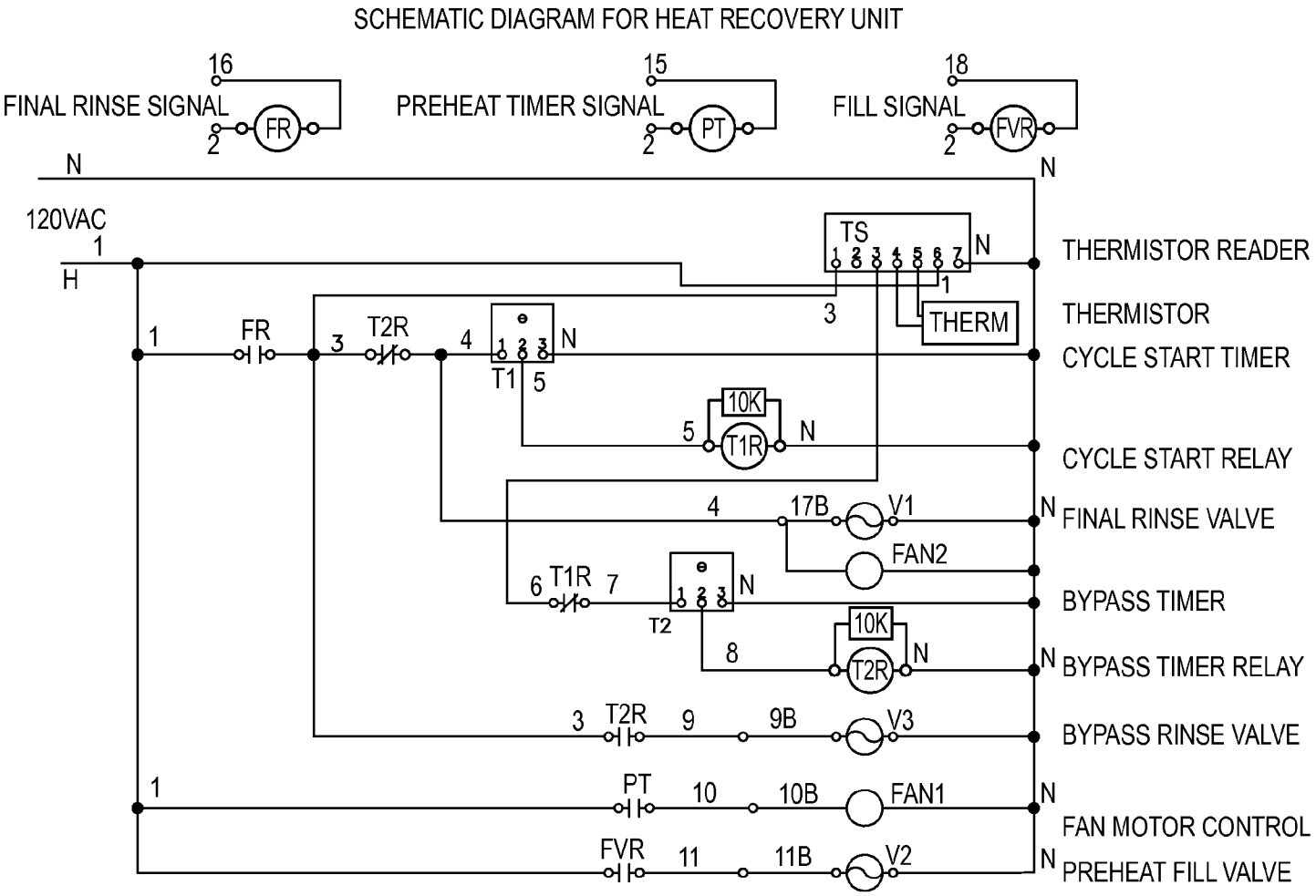
FIG. 4 shows an exemplary schematic diagram for the heat recovery unit of FIG. 3.
Figure 5:
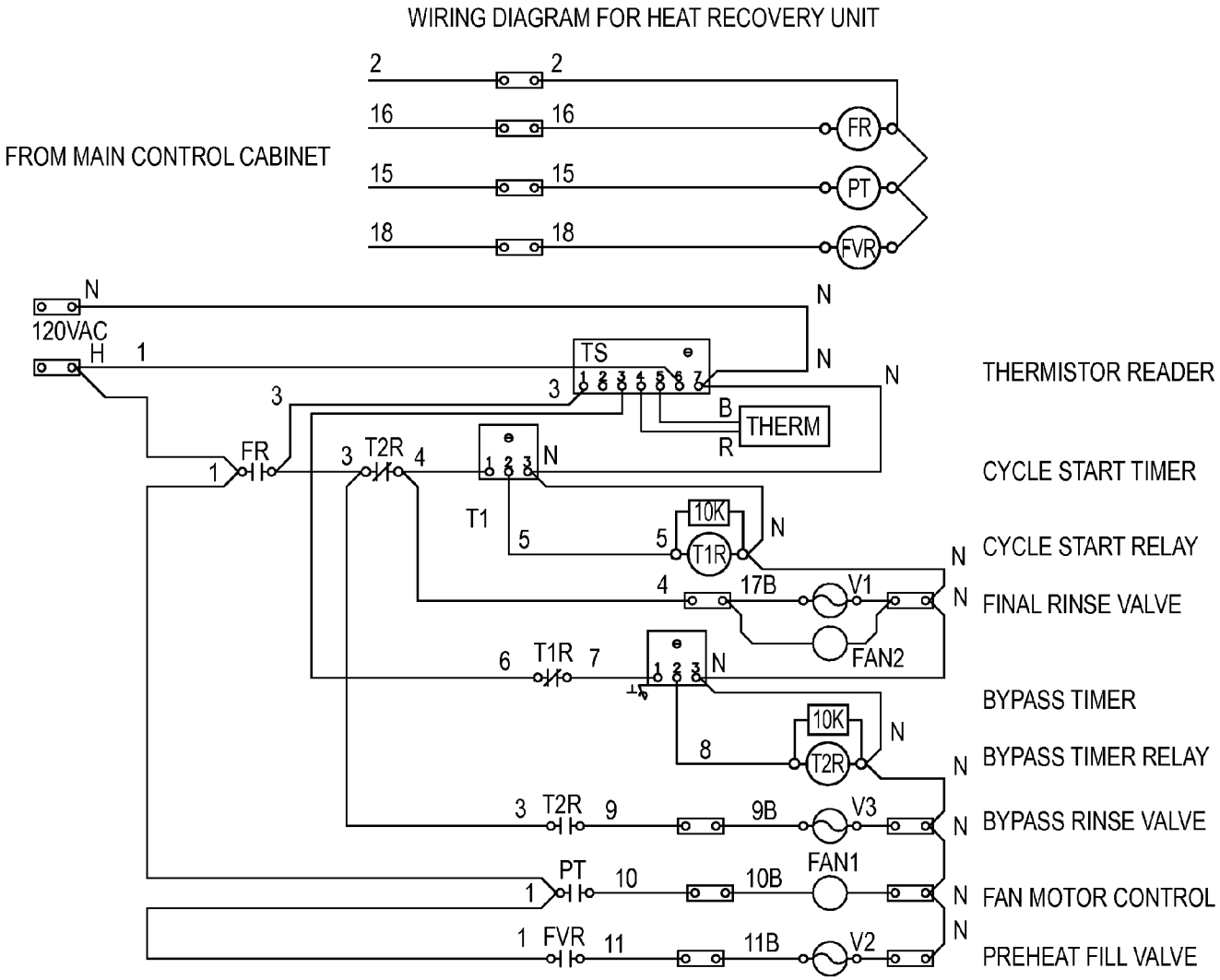
FIG. 5 shows an exemplary wiring diagram for the heat recovery unit of FIG. 3.

FIGS. 4 and 5 show an exemplary schematic diagram and wiring diagram, respectively, for one exemplary HRU 160 of the present invention. As shown by the schematic and wiring diagrams, the final rinse phase is triggered with the cycle start timer 192, and the operation of the final rinse phase and any associated bypass operations are associated with the output of the temperature monitor 180. Further, the schematic and wiring diagrams illustrate how one fan 164 may be activated as part of the preheat phase, while both fans 164 are activated during the final rinse phase. It will be appreciated that the present invention is not limited to the specific implementation illustrated by the schematic and wiring diagrams of FIGS. 4 and 5.

The above describes the invention in terms of two external water sources: a low temperature external water source 10 and a high temperature external water source 20. It will be appreciated that the present invention may be used with any external water sources that provide water at two different temperatures. More particularly, because the HRU 160 can heat cold water to the desired temperature threshold, the water supplied to the HRU 160 does not need to be preheated. It will be appreciated, however, that some low temperature external water sources 10 may supply minimally heated water. In either case, the water supplied by the low temperature external water source 10 has a temperature significantly below that of the high temperature external water source 20, e.g., by 60° F. to 70° F., and the hot vapors exhausted by the final rinse chamber 152 provides the majority if not all of the heat necessary to increase the temperature of the water input to the booster heater 154. This HRU 160 arrangement therefore provides considerable energy savings while still enabling the heating system 300 to meet the safety and efficiency requirements imposed by government regulators and customers.

While not required, heat conduction may provide an additional heat source for the HRU 160, particularly during the time that the final rinse module 150 is fully operating. For example, the HRU 160 and the final rinse module 150 and/or final rinse chamber 152 may be constructed of heat conducting materials, e.g., metal. By placing the HRU 160 in physical contact with the final rinse module 150 and/or the final rinse chamber 152, heat generated by the final rinse module 150 conducts to the HRU 160. This heat conduction serves to augment the exhaust hot vapors flowing through the HRU 160, and therefore aids in heating the water in the heat exchanger 162.

It will be appreciated that the present invention is not limited to the two fan solution shown in FIG. 3; additional fans 164 may be used. In the cases where more than two fans 164 are used, the controller 190 advantageously activates some number of fans 164 less than the total number during the preheat phase, and activates all the fans 164 during the final rinse phase. In addition, while the above discussion has been in terms of optionally varying the number of fans 164 that are operating at a given time, alternative embodiments may employ multi-speed fans 164, and different fan speeds may be used at different times. For example, when the dishwasher 100 is cleaning dishes, but the dishes have not yet reached the final rinse module 150, the multi-speed fan 164 may operate at a lower speed, thereby pulling the warm vapors from the dishwasher 100 relatively less vigorously. When the dishes reach the final rinse module 150, triggering full operation of the final rinse module 150, the multi-speed fan 164 may be switched to a higher speed, thereby pulling the warm vapors from the dishwasher 100 relatively more vigorously. Thus, the pulling/pushing force of the fan(s) may be altered in a variety of ways in the present invention.

The present invention may, of course, be carried out in other ways than those specifically set forth herein without departing from essential characteristics of the invention. The present embodiments are to be considered in all respects as illustrative and not restrictive, and all changes coming within the meaning and equivalency range of the appended claims are intended to be embraced therein.

What is claimed is:

1. A method of heating water for a dishwasher, the method comprising:

supplying water from a low temperature external water source to a heat recovery unit having a heat exchanger;

priming the heat recovery unit during a preheat phase by activating a first number of fans to pull hot vapors exhausted by the dishwasher across the heat exchanger;

heating the water flowing through the heat recovery unit using heat recovered from hot vapors exhausted by the dishwasher routed into the heat recovery unit;

selecting an input water supply for a booster heater downstream from the heat recovery unit based on a sensed temperature of the water at the output of the heat recovery unit;

wherein the heat recovery unit supplies the input water to the booster heater in response to the sensed temperature meeting or exceeding a threshold; and wherein a high temperature external water source that meets or exceeds the threshold bypasses the heat recovery unit and supplies the input water to the booster heater in response to the sensed temperature being less than the threshold;

wherein heating the water flowing through the heat recovery unit comprises activating a second number of fans greater than the first number of fans upon completion of the preheat phase to pull the hot vapors exhausted by the dishwasher across the heat exchanger while flowing the water supplied by the low temperature external water source through the heat exchanger.

2. The method of claim 1 further comprising disconnecting the high temperature external water source from the booster heater and reconnecting the booster heater to the heat recovery unit and the low temperature external water source to supply the input water from the heat recovery unit to the booster heater upon expiration of a bypass timer.

3. The method of claim 1 further comprising conducting heat from the dishwasher to the heat recovery unit by disposing at least part of the heat recovery unit in direct contact with the dishwasher.

4. The method of claim 1 further comprising, during the preheat phase occurring prior to the supplying water from the low temperature external water source, routing water from the high temperature external water source through the heat exchanger of the heat recovery unit.

5. A heating system for a dishwasher, comprising:

a heat recovery unit comprising a heat exchanger disposed in a housing, said heat recovery unit configured to heat water supplied by a low temperature external water source to the heat recovery unit using hot vapors exhausted by the dishwasher into the heat recovery unit; wherein the heat recovery unit further comprises a plurality of fans;

a temperature monitor to sense a temperature of the water at an output of the heat recovery unit;

a booster heater having an input selectively connected to one of the output of the heat recovery unit and a high temperature external water source that supplies water at a temperature that meets or exceeds a temperature threshold;

a controller configured to control the flow of the water supplied by the low temperature and high temperature water sources through the heating system, the controller configured to:

supply the water from the low temperature external water source to the heat recovery unit and supply the water output by the heat recovery unit to the booster heater in response to the sensed temperature of the water output by the heat recovery unit meeting or exceeding the threshold;

bypass the heat recovery unit and supply water from the high temperature external water source to the booster heater in response to the sensed temperature of the water output by the heat recovery unit being less than the threshold;

prime the heat recovery unit during a preheat phase by activating a first number of the fans less than all the plurality of fans to pull the hot vapors exhausted by the dishwasher across the heat exchanger;

activate a second number of fans greater than the first number of fans upon completion of the preheat phase to pull the hot vapors exhausted by the dishwasher across the heat exchanger while flowing the water supplied by the low temperature external water source through the heat exchanger.

6. The heating system of claim 5 wherein the controller is further configured to disconnect the booster heater from the high temperature external water source and reconnect the booster heater to the heat recovery unit and the low temperature external water source upon expiration of a bypass timer.

7. The heating system of claim 5 wherein the controller is further configured to prime the heat recovery unit during the preheat phase by routing water supplied by the high temperature external water source through the heat exchanger.

8. A method of heating water for a dishwasher, the method comprising:

routing water supplied by a high temperature external water source through a heat recovery unit during a preheat phase, the heat recovery unit having a heat exchanger;

upon completion of the preheat phase:

switching supply of additional water to the dishwasher from the high temperature external water source to a low temperature external water source; and thereafter, flowing water supplied by the low temperature external water source into the heat exchanger, and heating the water flowing through the heat exchanger using heat recovered from hot vapors exhausted by the dishwasher into the heat recovery unit;

selecting an input water supply for a booster heater downstream from the heat recovery unit based on a sensed temperature of the water at the output of the heat recovery unit;

wherein the heat recovery unit supplies the input water to the booster heater in response to the sensed temperature meeting or exceeding a threshold; and wherein a high temperature external water source that meets or exceeds the threshold bypasses the heat recovery unit and supplies the input water to the booster heater in response to the sensed temperature being less than the threshold.

9. The method of claim 8 further comprising activating at least one fan to pull hot vapors exhausted by the dishwasher across the heat exchanger to increase the temperature of the heat exchanger during the preheat phase.

10. The method of claim 9 further comprising activating additional fans upon completion of the preheat phase to pull the hot vapors exhausted by the dishwasher across the heat exchanger.

11. A heating system for heating water for a dishwasher, comprising:

a heat recovery unit comprising a heat exchanger and a plurality of fans;

a controller configured to:

route water supplied by a high temperature external water source through said heat exchanger during a preheat phase; and upon completion of the preheat phase, flow water from a low temperature external water source into the heat exchanger to heat the water flowing through the heat exchanger using heat recovered from hot vapors exhausted by the dishwasher into the heat recovery unit;

wherein the controller is further configured to:

prime the heat recovery unit during the preheat phase by activating a first number of the fans less than all the plurality of fans to pull the hot vapors exhausted by the dishwasher across the heat exchanger;

activate a second number of fans greater than the first number of fans upon completion of the preheat phase to pull the hot vapors exhausted by the dishwasher across the heat exchanger while flowing the water supplied by the low temperature external water source through the heat exchanger.

12. A method of heating water for a dishwasher, the method comprising:

supplying water from a low temperature external water source to a heat recovery unit having a heat exchanger;

priming the heat recovery unit during a preheat phase;

pulling, by a first number of fans, hot vapors exhausted by the dishwasher across the heat exchanger in the heat recovery unit to increase the temperature of the heat exchanger during the preheat phase;

selecting an input water supply for a booster heater downstream from the heat recovery unit based on a sensed temperature of the water at the output of the heat recovery unit;

wherein the heat recovery unit supplies the input water to the booster heater in response to the sensed temperature meeting or exceeding a threshold; and wherein a high temperature external water source that meets or exceeds the threshold bypasses the heat recovery unit and supplies the input water to the booster heater in response to the sensed temperature being less than the threshold;

upon completion of the preheat phase, heating water flowing through the heat exchanger using heat recovered from hot vapors exhausted by the dishwasher into the heat recovery unit by pulling, by a second number of fans greater than the first number of fans, the hot vapors exhausted by the dishwasher across the heat exchanger.

* * * * *